United States Patent [19]

Yoshida et al.

[11] Patent Number: 4,594,753

[45] Date of Patent: Jun. 17, 1986

[54] SEPARABLE SLIDE FASTENER

[75] Inventors: Hiroshi Yoshida; Yoshiharu Yamaguchi, both of Toyama, Japan

[73] Assignee: Yoshida Kogyo K. K., Tokyo, Japan

[21] Appl. No.: 535,797

[22] Filed: Sep. 26, 1983

[30] Foreign Application Priority Data

Sep. 27, 1982 [JP] Japan ..... 57-145927[U]

[51] Int. Cl.[4] ..... A44B 19/36

[52] U.S. Cl. ..... 24/433; 24/434

[58] Field of Search ..... 24/433, 434, 435

[56] References Cited

U.S. PATENT DOCUMENTS

| | | | |
|---|---|---|---|
| 3,170,207 | 2/1965 | Morin | 24/433 |
| 3,365,758 | 1/1968 | Hansen | 24/433 X |
| 3,507,013 | 4/1970 | Inazawa | 24/434 |
| 3,922,761 | 12/1975 | Schwendt | 24/434 |
| 4,312,103 | 1/1982 | Akashi | 24/434 |
| 4,459,723 | 7/1984 | Takano et al. | 24/433 X |

FOREIGN PATENT DOCUMENTS

| | | | |
|---|---|---|---|
| 2733532 | 2/1978 | Fed. Rep. of Germany | 24/433 |

*Primary Examiner*—William E. Lyddane
*Assistant Examiner*—Peter A. Aschenbrenner
*Attorney, Agent, or Firm*—Hill, Van Santen, Steadman & Simpson

[57] ABSTRACT

An improved slide fastener with a separator attached thereto of the type including a pair of fastener stringers and a pair of male and female members constituting the separator is disclosed. A stepped portion is provided for each of the fastener stringers between the lowermost end of the fastener element and the core portion formed at the lower end part of the fastener stringer. Each of the male and female members is formed with a slit-shaped groove at its upper side wall so that it is fixedly secured to the fastener stringer by causing the stepped portion to abut against the engagement groove. Each of the male and female members is preferably fixed to the associated fastener stringer by caulking or notch-like fingers.

3 Claims, 6 Drawing Figures

SEPARABLE SLIDE FASTENER

BACKGROUND OF THE INVENTION

1. Field of the Invention

The present invention relates to an improved slide fastener with a separator attached thereto and more particularly to a mounting construction of a pair of male and female members in the form of rod constituting the separator with a pair of fastener stringers.

2. Description of the Prior Art

The conventional method for manufacturing a slide fastener with a separator attached thereto are as follows:

(1) An elongate slide fastener chain of a pair of fastener stringers is prepared, each of said fastener stringers having a fastener element in the form of coil secured along the one edge of a fastener tape by sewing threads. The coil element includes a core cord extending therewithin and the sewing thread pierces the core cord so that the coil element is fixedly secured to the fastener tape.

(2) A part of the length of the engaged coil elements is cut off by a predetermined length at a predetermined interval and is removed from the fastener stringers whereby an area where no element is secured to the fastener stringers is formed. On this stage, the core cord remains in the area of the fastener stringer.

(3) Both the front and rear surfaces of said area are lined with a reinforce film by thermal fusion respectively and then this area is cut to a predetermined configuration. It should be noted that a core portion is formed at the area by using the remaining core cord.

(4) The longitudinally extending fastener chain is cut to a predetermined length at the aforesaid area. Next, the pair of fastener stringers are separated away from one another and a slider is fitted onto one of the fastener stringers.

(5) The core portion of the one fastener stringer is fitted with a male member and the core portion of the other one is fitted with a box having a female member formed integrally therewith. The box having the female member and male member are then fixed to the fastener stringers by caulking in a vertical direction.

Since with the conventional method as described above, the male and female members or the bar members are fitted to the core portion formed at the lower part of each of the fastener stringers without any aid of locating reference or guide, it has been often found that the bar members are fitted excessively far onto the core portion or by an excessively short distance. The side wall of the bar members should be located at a right angle relative to the reinforce film but it is sometimes found that the bar members are turned or twisted about the axis extending in the longitudinal direction of the fastener stringers.

Any incorrect locating of the bar members cause the slider to be inhibited from smooth movement after male member is inserted into the box to which the female member is fixed, resulting in the production of failure.

SUMMARY OF THE INVENTION

The present invention has been made with the foregoing drawbacks inherent to the conventional mounting construction of the bar member in mind and its object resides in providing a mounting construction of the bar member with a slide fastener having a separator attached thereto in which bar members can be fixedly secured to a pair of fastener stringers precisely at a high speed.

To accomplish the above object there is proposed in accordance with the present invention a mounting construction of bar member with a separable slide fastener of the early-mentioned type, wherein the improvement consists in that a stepped portion is provided between the lowermost end of the coil element and the core portion while each of the bar members is formed with a slit-shaped engagement groove at its upper side wall which is opened toward the fastener stringer so that it is fixedly secured to the fastener stringer by causing the stepped portion to come in abutment against said engagement groove.

When the bar members are fitted onto each of the fastener stringers, they are displaced upward by causing the inner wall surface of each of the bar members to slide along the outer surface of the fastener stringers until each of the stepped portion on the fastener stringers comes in abutment against the deepest portion of the engagement groove on the bar members. Further, since the position where the upward displacement of the bar member is stopped due to abutment of the stepped portion against the deepest point of the engagement groove is predetermined at a certain position, it is assured that the bar member is fitted onto each of the fastener stringers reliably and quickly. The arrangement made in that way makes it possible not only to correctly locate the bar member in the longitudinal direction relative to the fastener stringer but also to inhibit an occurance of turning movement of the bar member about the axis extending in the longitudinal direction of the fastener stringer.

The bar member is firmly secured to each of the fastener stringers by caulking in a vertical direction.

Other objects, features and advantages of the present invention will become more clearly apparent from reading of the following description which has been prepared in conjunction with the accompanying drawings.

BRIEF DESCRIPTION OF THE DRAWINGS

The accompanying drawings will be briefly described below.

DETAILED EXPLANATION OF THE INVENTION

Now, the present invention will be described in a greater detail hereunder with reference to the accompanying drawings which illustrate a mounting construction of a bar member with a slide fastener having a separator attached thereto to which the present invention is applied.

It should be noted that since the male and female members constituting the bar members have the substantially same configuration and have the substantially same essential parts, description will be made only with respect to the male member.

Figure 1:
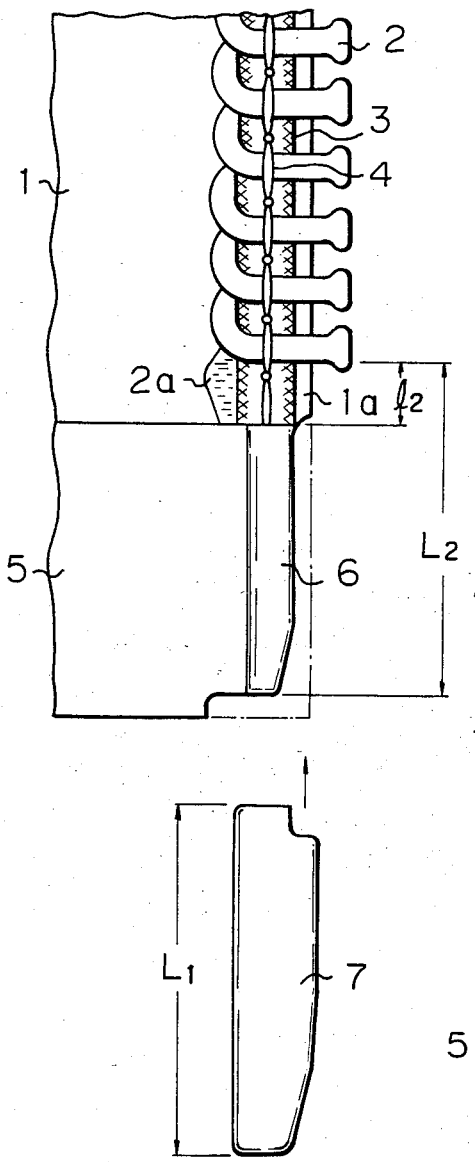
FIG. 1 is a fragmental plan view of one of fastener stringers showing that male member is unfitted thereto.
Figure 2:
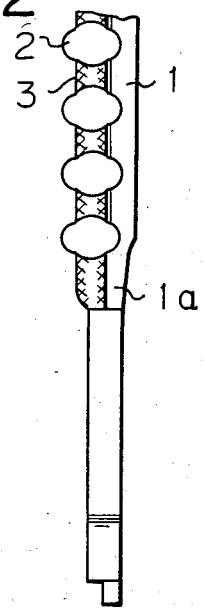
FIG. 2 is a side view of the fastener stringer in FIG. 1.

FIG. 1 is a fragmental plan view of one of fastener stringers showing that a male member is unfitted thereto. In the drawings reference numeral 1 designates a lefthand fastener stringer with a male member 7 to be described later attached thereto. As is apparent from the drawings, a fastener element 2 in the form of a coil is fixedly secured to the righthand edge of the fastener stringer 1 by a sewing thread 4 as seen in FIG. 1. A core cord 3 extends within the coil element 2 in a longitudinal direction and the sewing thread 4 pierces the core cord so that the fastener element 2 is fixedly secured to the fastener stringer 1.

The cut reversed connecting portion 2*a* of the lowermost end of the coil element 2 is fused with the fastener stringer.

Further, both the upper and lower surfaces of the fastener stringer 1 are lined with a reinforce film 5 at its lower end part by thermal fusion respectively and thereafter it is cut to a predetermined configuration. In the preferred form shown in the drawings, the lower end part of the fastener stringer 1 is cut to L-configuration. Since the fastener element 2 under the reversed connecting portion 2*a* is removed from the fastener stringer 1 and the core cord 3 remains on the stringer 1, a core portion 6 of larger thickness than that of the fastener tape projecting from the surface of the reinforce film 5 is formed by using the remaining core cord 3 when the reinforce film 5 is fused with the lower end part of the stringer 1 and the stringer 1 is cut in a predetermined configuration. The core portion 6 also defines the side edge of the lower end part of the fastener stringer 1. The core portion 6 is formed on the extension of the core cord 3 extending continually with the fastener element 2 and acts as a mounting means for the male 7 hereunder described. A stepped portion 1*a* of the stringer 1 is formed between the lowermost end portion of the fastener element 2 and the upper end of the core portion 6 and is extending outwardly beyond the outer edge of the core portion 6.

Figure 3:
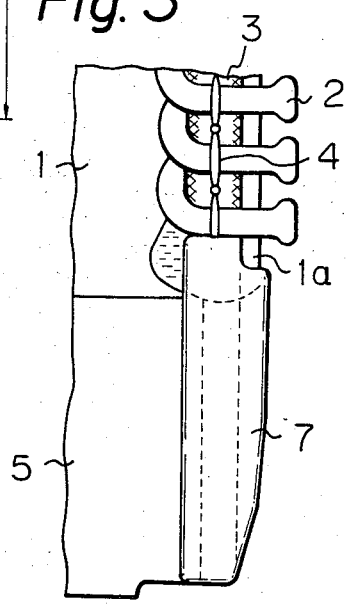
FIG. 3 is a fragmental plan view of the fastener stringer in FIG. 1 which is fitted with the male member.
Figure 4:
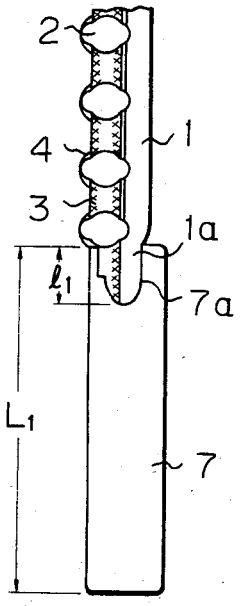
FIG. 4 is a side view of an assembly of the fastener stringer and the male member in FIG. 3.
Figure 6:
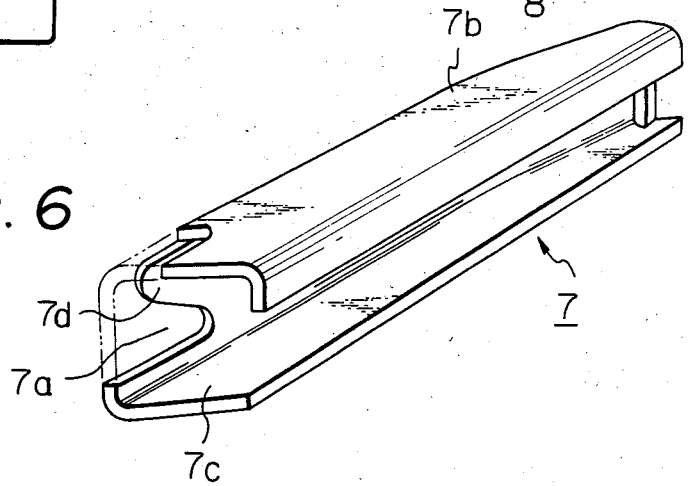
FIG. 6 is a perspective view of a male member to be fixed to the fastener stringer.

Reference numeral 7 designates a male member having a substantially U-shaped cross sectional configuration. The male member is made of upper wall 7*b*, lower wall 7*c*, and side wall 7*d* as shown in FIG. 6. The upper portion of the side wall 7*d* is formed with a slit-like engagement groove 7*a* open to the fastener element 2. The engagement groove 7*a* is adapted to come into engagement with the stepped portion 1*a* of the fastener stringer 1. In the preferred form of the present invention as shown, the engagement groove 7*a* is formed to U-shape. The length L1 of the male member 7 in a longitudinal direction is substantially equal to the length L2 between the lowermost portion of the fastener element 2 and the lower end of the core cord 6. And the length l1 between the upper end of the male member 7 and the deepest point of the engagement groove 7*a* is substantially equal to the length l2 between the lowermost portion of the fastener element 2 and the shoulder formed at the lower end of the stepped portion 1*a*. Therefore, the male member 7 is correctly attached to the fastener stringer 1, when the shoulder of the stepped portion 1*a* is engaged with the deepest point of the engagement groove 7*a*. At this time, the upper end surface of the male member 7 abuts against the lowermost portion of the fastener element 2. When the male member 7 is fitted to the lower end portion of the fastener stringer 1, the male member 7 is inserted over the core portion 6 in the direction as identified with an arrow shown in FIG. 1, while the inner surface of the male member 7 is guided by the core portion 6. In the last step of insertion, the engagement groove 7*a* formed in the side wall 7*d* of the male member 7 is guided by the stepped portion 1*a* of the fastener stringer 1, and insertion of the male member 7 is finally caused to stop when the shoulder formed at the lower end of the stepped portion 1*a* abuts against the deepest point of the engagement groove 7*a*. After that the male member 7 is fixedly secured to the fastener stringer 1 by caulking the upper wall 7*b* and lower wall 7*c* or by notch-like finger formed on the upper wall and lower wall. Incidentally, FIG. 3 is a fragmental plan view which illustrates how the male member 7 is fixedly secured to the fastener stringer 1 and FIG. 4 is a side view of the fastener stringer 1 with the male member 7 firmly secured thereto.

Figure 5:
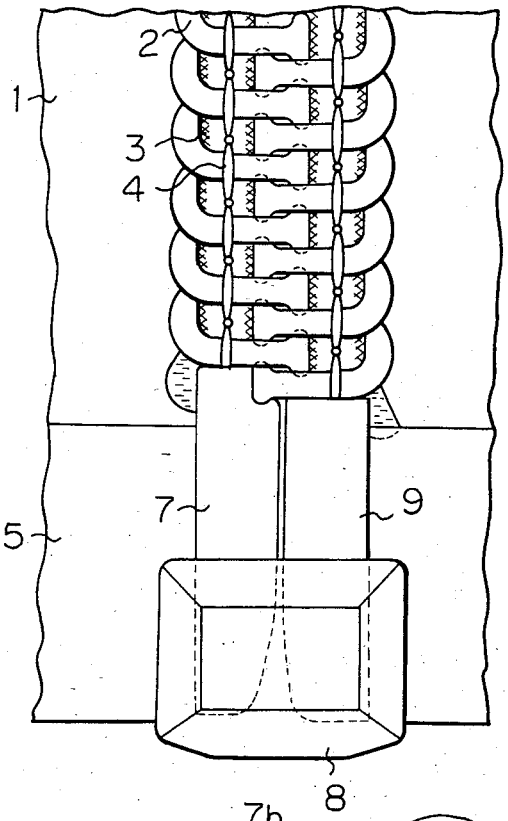
FIG. 5 is a fragmental plan view of the separable slide fastener of the invention of which fastener stringers are engaged to one another in the closed state.

As will be readily understood from the above description, the mounting construction of male member with the slide fastener with a separator attached thereto ensures the correct positioning of the male member with respect to the fastener stringer by providing the slot-like engagement groove with the upper portion of the side wall of the male member constituting a part of the bar member and by providing the stepped portion 1*a* with the fastener stringer thereby contacting the former with the latter. Further, since the male member 7 is inhibited from turning movement about the axis extending in the longitudinal direction of the fastener stringer, there is no fear of causing an occurance of incorrect locating, twisting or the like of the male member 7 relative to the female member 9 after it is inserted into the box 8 so as to close a fastener chain as illustrated in FIG. 5.

While the present invention has been described above merely with respect to a single preferred embodiment, it should of course be understood that it should not be limited only to this but various changes or modifications may be made in a suitable manner without any departure from the spirit and scope of the invention.

What is claimed is:

1. A separable slide fastener comprising:

a pair of fastener stringers each of which has a fastener tape, a fastener element in the form of a coil fixedly sewn on said tape along a vertically extending side margin of said fastener stringer, a core cord threaded through said fastener element and disposed laterally inward of the side margin of said fastener stringer, reinforcing film means attached to a lower end portion of said fastener stringer and having a core portion of relatively larger thickness than that of said fastener tape formed about an extension of said core cord beneath said fastener element, said core portion defining a vertically extending further side margin beneath said fastener element, the side margin of said fastener stringer disposed laterally outwardly of the further side margin, and a stepped portion on said fastener stringer extending laterally between said side margins and lengthwise disposed between the lowermost end of said fastener element and the uppermost end of said core portion;

a pair of bar members, each having a substantially U-shaped sidewall configuration in cross-section, for sliding over said core portions respectively and being fixedly secured thereto, each bar member having an engagement groove in one end of one said sidewall open to said fastener element such that said engagement groove is guided over said stepped portion until stopped by a lowermost end of said engagement groove; and a box attached to said bar members for closing together lower ends of said bar members.

2. A separable slide fastener according to claim 1 wherein the engagement groove is substantially U-shaped in plan profile.

3. A separable slide fastener according to claim 1, wherein each bar member is of a length substantially equal to the length between the lowermost end of the fastener element and the lower end of the core portion and the length between the upper end of the bar member and the deepest point of the engagement groove is substantially equal to the longitudinal length of the stepped portion beneath the lowermost end of the fastener element.

* * * * *